US008876071B2

(12) United States Patent
Brooke

(10) Patent No.: US 8,876,071 B2
(45) Date of Patent: Nov. 4, 2014

(54) SELF-STABILIZING SUPPORT ASSEMBLY FOR AN ITEM OF FURNITURE

(75) Inventor: Rory Brooke, Meyerton (ZA)

(73) Assignee: Hedera AB, Lund (SE)

( * ) Notice: Subject to any disclaimer, the term of this patent is extended or adjusted under 35 U.S.C. 154(b) by 425 days.

(21) Appl. No.: 13/146,797

(22) PCT Filed: Jan. 28, 2010

(86) PCT No.: PCT/IB2010/050379

§ 371 (c)(1),
(2), (4) Date: Dec. 9, 2011

(87) PCT Pub. No.: WO2010/086811

PCT Pub. Date: Aug. 5, 2010

(65) Prior Publication Data

US 2012/0091770 A1 Apr. 19, 2012

Related U.S. Application Data

(60) Provisional application No. 61/148,079, filed on Jan. 29, 2009.

(51) Int. Cl.
*A47B 91/16* (2006.01)

(52) U.S. Cl.
CPC ..... *A47B 91/16* (2013.01)
USPC ..... 248/188.8; 248/188.1; 108/156

(58) Field of Classification Search
CPC ..... A47B 13/00; A47B 91/16
USPC ..... 248/188.3, 582, 188.1, 188.8; 108/156, 108/158, 158.13; 297/264.1, 265.1, 270.1
See application file for complete search history.

(56) References Cited

U.S. PATENT DOCUMENTS

| | | | | |
|---|---|---|---|---|
| 3,877,669 | A | 4/1975 | Ambasz | |
| 4,178,858 | A | 12/1979 | Ponzellini | |
| 4,406,437 | A | 9/1983 | Wright | |
| 4,712,758 | A | 12/1987 | Cuschera | |
| 4,789,122 | A | 12/1988 | Gutgsell | |
| 5,690,303 | A | 11/1997 | Winters | |
| 5,899,422 | A * | 5/1999 | Eke | 248/188.4 |

(Continued)

FOREIGN PATENT DOCUMENTS

| | | |
|---|---|---|
| CN | 2569974 | 9/2003 |
| CN | 1590783 | 3/2005 |

(Continued)

*Primary Examiner* — Terrell McKinnon
*Assistant Examiner* — Eret McNichols
(74) *Attorney, Agent, or Firm* — Hamre, Schumann, Mueller & Larson, P.C.

(57) ABSTRACT

A support assembly for an item of furniture with an elongated support structure having a first pair of feet connected to a lower end thereof; a passage defining unit defining a guide passage connected to the support structure and extending lengthwise; a support member displaceable with respect to the support structure having a second pair of feet at its lower end thereof; the displaceable support member provided with a guided pin complementary to and longitudinally slidably engaged in the guide passage, characterized thereby that the passage defining unit has a hollow adjustable guide member whereby the dimension of the passage is adjustable in accordance with the dimension of the pin; and the passage defining unit is fastenable to the support structure once it has been adjusted, such that the passage defining unit may first be adjusted to conform with the guide pin and then be fastened to the support structure.

38 Claims, 3 Drawing Sheets

(56) References Cited

U.S. PATENT DOCUMENTS

| | | | | |
|---|---|---|---|---|
| 6,578,804 | B2 * | 6/2003 | Lin et al. | 248/188.7 |
| 7,111,819 | B2 | 9/2006 | Mikiya et al. | |
| 7,290,741 | B1 | 11/2007 | Cox et al. | |
| 7,677,524 | B2 | 3/2010 | Brooke | |
| 7,930,980 | B2 | 4/2011 | Brooke | |
| 2003/0230681 | A1 * | 12/2003 | Gwynneth | 248/188.3 |
| 2007/0252053 | A1 | 11/2007 | Brooke | |
| 2008/0087777 | A1 | 4/2008 | Christian et al. | |
| 2012/0085873 | A1 | 4/2012 | Brooke | |
| 2012/0091770 | A1 | 4/2012 | Brooke | |
| 2012/0193503 | A1 * | 8/2012 | Pike | 248/560 |

FOREIGN PATENT DOCUMENTS

| | | |
|---|---|---|
| CN | 1882269 | 12/2006 |
| CN | 2879812 | 3/2007 |
| JP | 54-16265 | 2/1979 |
| WO | 2005/034680 | 4/2005 |
| WO | 2006/016199 | 2/2006 |

* cited by examiner

SELF-STABILIZING SUPPORT ASSEMBLY FOR AN ITEM OF FURNITURE

THIS INVENTION relates to furniture. In particular, the invention relates to a support assembly for an item of furniture, to a method of manufacturing a support assembly for an item of furniture, and to a self-stabilizing arrangement for an item of furniture. It relates also to an item of furniture.

The invention is expected to be used in the context of tables, stools and chairs, having substantially operatively horizontal tops or seat portions which are supported above a surface on which the table, stool or chair is operatively located. For purposes of this specification, the term "upper portion" is to be understood as including a table top and a seat portion of a stool or chair.

In accordance with one aspect of the invention there is provided a support assembly for an item of furniture, which support assembly includes:

an elongated support structure for connection at an operatively upper end thereof to an upper portion of an item of furniture;

a first pair of feet connected to the support structure, at or adjacent an operatively lower end thereof;

an elongated guide formation connected to the support structure and extending lengthwise relative to the support structure;

a support member displaceable with respect to the support structure which has a second pair of feet at or adjacent an operatively lower end thereof, the displaceable support member being arranged relative to the support structure so that a line drawn between the feet of the first pair is transverse to a line drawn between the feet of the second pair;

the displaceable support member also being provided with an elongated guided formation complementary to and longitudinally slidably engaged with the guide formation, so that the displaceable support member is slidably displaceable along a rectilinear guide path which is transverse to the lines drawn between both the pairs of feet, with one of the guide formation and the guided formation being in the form of a guided pin, the other one of the guide formation and the guided formation being in the form of a passage defining unit defining a guide passage within which the guided pin is longitudinally slidably received, the dimensions of the passage and the guided pin being such that automatic frictional engagement of the guided pin occurs, in use, with a surface of the passage in response to pivoting of the displaceable support member about a pivot axis which is transverse to the displaceable support member's guide path, automatically to anchor the displaceable support member frictionally against sliding displacement relative to the support structure, characterised thereby that the passage defining unit has a hollow adjustable guide member whereby the dimension of the passage is adjustable in accordance with the dimension of the pin; and the passage defining unit is fastenable to the support structure or the support member, as the case may be, once it has been adjusted, such that the passage defining unit may first be adjusted to conform with the guided pin and then be fastened to the support structure or the support member.

Further according to the first aspect of the invention there is provided a method of manufacturing a support assembly for an item of furniture, which includes providing an elongated support structure for connection at an operatively upper end thereof to an upper portion of an item of furniture and having a first pair of feet connected therewith, at or adjacent an operatively lower end thereof, and an elongated guide formation connected therewith and extending lengthwise relative to the support structure;

providing a support member displaceable with respect to the support structure which has a second pair of feet at or adjacent an operatively lower end thereof, the displaceable support member being arrangeable relative to the support structure so that a line drawn between the feet of the first pair is transverse to a line drawn between the feet of the second pair and also has an elongated guided formation complementary to and longitudinally slidably engageable with the guide formation, so that the displaceable support member is slidably displaceable along a rectilinear guide path which is transverse to the lines drawn between both the pairs of feet, with one of the guide formation and the guided formation being in the form of a guided pin, the other one of the guide formation and the guided formation being in the form of a passage defining unit defining a guide passage within which the guided pin is longitudinally slidably received, the dimensions of the passage and the guided pin being such that automatic frictional engagement of the guided pin occurs, in use, with a surface of the passage in response to pivoting of the displaceable support member about a pivot axis which is transverse to the displaceable support member's guide path, automatically to anchor the displaceable support member frictionally against sliding displacement relative to the support structure, with the passage defining unit having a hollow adjustable guide member whereby the dimension of the passage is adjustable in accordance with the dimension of the pin; and being fastenable to the support structure or the support member, as the case may be, once it has been adjusted, characterised thereby that the passage defining unit is first adjusted to conform with the guided pin and it is then fastened to the support structure or the support member.

The guide passage may be of circular cross-section, the guided pin being: circular cylindrical. The guide member may then comprise a pair of complementary substantially semicircular guide shells with a tightening mechanism for tightening them together, thereby to vary the dimension of the passage defined therebetween. Conveniently the passage defining unit may have a pair of longitudinally spaced adjustable guide components, inner surfaces of which define the passage, that are housed in the guide member. These guide components may be split rings or bushes, or substantially semicircular guide elements that are received in longitudinally spaced grooves in the guide shells.

The passage defining unit may have fastening formations by means of which it is fastened to the support structure or support member respectively. These may comprise bores in the guide member.

The guided formation may be constituted by the guided pin, the guided pin projecting operatively upwardly from an operatively upper end of the support member, and the guide formation being constituted by the guide passage defined by the passage defining unit, with the passage defining unit being centrally located with respect to the support structure at an operatively lower end thereof.

The support structure may comprise an elongated operatively upright post and a spider formation connected to an operatively lower end of the post, the spider formation comprising four radially outwardly projecting spokes which are equiangularly spaced about a longitudinal axis of the post, each spoke being channel-shaped and opening operatively downwardly, with the passage defining unit being removably fastened about an aperture in the spider formation and projecting centrally operatively upwardly therefrom.

One pair of aligned spokes may be provided with the first pair of feet, the feet of the first pair respectively being provided at ends of the spokes of said one pair of spokes.

The displaceable support member may comprise an arm which is received in the channel defined by the other pair of aligned spokes and extending lengthwise therealong, the feet of the second pair of feet respectively being provided at the ends of the arm.

The arm and the guided pin may be integrally formed. Instead, the guided pin may be removably secured to the arm.

The support assembly may include at least one urging member for urging the arm operatively downwardly away from the support structure. Conveniently, one urging member may be used, being located on the guided pin. Instead the support assembly may include two urging members which are equally spaced on opposite sides of the guided pin, each urging member being in the form of a compressed spring located in the channel defined by said other pair of spokes and acting between the spokes and the arm.

The support assembly may also include a securing formation connected to an operatively upper end of the guided pin, which securing formation holds the guided pin captive in the passage defining unit.

The feet of the second pair may be spaced at equal distances from a longitudinal axis of the guide formation. Further, the feet of the first pair may be spaced the same distance from a longitudinal axis of the guide formation as the feet of the second pair are spaced from the longitudinal axis of the guide formation.

The line drawn between the first pair of feet and the line drawn between; the second pair of feet may be at right angles to each other.

The guide member may have grooves in which the guide components are received.

The guide member may be of a non-metallic material. Preferably it may be of a synthetic plastics material which may be fibre reinforced.

In accordance with a second aspect of the invention there is provided a self-stabilizing arrangement for an item of furniture, which arrangement includes:

an elongated first support component having at each end a foot projecting in the same direction;

an elongated guide formation connected to the first support component;

and an elongated second support component having at each end a foot projecting in the same direction as the feet of the first support component, the second support component including an elongated guided formation complementary to and longitudinally slidably engaged with the guide formation, one of the guide formation and the guided formation being in the form of a guided pin, the other one of the guide formation and the guided formation being in the form of a passage defining unit connected to the associated one of the first and the second support components and which defines a guide passage within which the guided pin is longitudinally slidably received, such that the second support component is slidably displaceable relative to the first support component, with the passage defining unit comprising a hollow adjustable guide member whereby the dimension of the passage is adjustable in accordance with the dimension of the pin; and the passage defining unit being fastenable to the first support component or the second support component, as the case may be, once it has been adjusted, such that the passage defining unit may first be adjusted to conform with the guided pin and then be fastened to the first support component or the second support component.

Further In accordance with the second aspect of the invention there is provided a method of manufacturing a self-stabilizing arrangement for an item of furniture, which arrangement includes:

an elongated first support component having at each end a foot projecting in the same direction and an elongated guide formation connected therewith;

an elongated second support component having at each end a foot projecting in the same direction as the feet of the first support component and including an elongated guided formation complementary to and longitudinally slidably engaged with the guide formation, with one of the guide formation and the guided formation being in the form of a guided pin and the other one of the guide formation and the guided formation being in the form of a passage defining unit connected to the associated one of the first and the second support components and which defines a guide passage within which the guided pin is longitudinally slidably received, such that the second support component is slidably displaceable relative to the first support component, with the passage defining unit comprising a hollow adjustable guide member whereby the dimension of the passage is adjustable in accordance with the dimension of the pin; and the passage defining unit being fastenable to the first support component or the second support component, as the case may be, once it has been adjusted, such that the passage defining unit may first be adjusted to conform with the guided pin and then be fastened to the first support component or the second support component, the method including first adjusting the passage defining unit to conform with the guided pin and then fastening the passage defining unit to the first support component or the second support component, as the case may be.

As indicated above, the guide passage may be of circular cross-section, the guided pin being: circular cylindrical. The guide member may then comprise a pair of complementary substantially semicircular guide shells with a tightening mechanism for tightening them together, thereby to vary the dimension of the passage defined therebetween. Conveniently the passage defining unit may have a pair of longitudinally spaced adjustable guide components, inner surfaces of which define the passage, that are housed in the guide member. These guide components may be split rings or bushes, or substantially semicircular guide element that are received in longitudinally spaced grooves in the guide shells The passage defining unit may have fastening formations by means of which it is fastened to the first support component or the second support component, respectively. These may comprise bores in the guide member.

The guided formation may be constituted by the guided pin, the guided pin being centrally connected to the second support component and projecting in the opposite direction to the feet, the guide formation being constituted by the passage defining unit, the passage defining unit being removably fastened to and centrally located with respect to the first support component. The first support component and the second support component may be orthogonal.

The arrangement may include a locating arrangement, the locating arrangement keeping the first and the second support components in a predetermined relative configuration.

The locating arrangement may include a pair of longitudinally aligned spokes connected to the first support component and projecting radially outwardly therefrom, such that the spokes and the first support component are orthogonal, the spokes being shaped to define a locating channel opening in the same direction as the direction in which the feet project, the second support component being located in a channel defined by one pair of aligned spokes.

The guide formation and the guide components may be shaped and dimensioned such that there is limited clearance between the guided pin and inner surfaces of the guide components, so that automatic frictional locking of the second support component relative to the first support component occurs when a nett moment about an axis transverse to a longitudinal axis of the guided pin is exerted on the second support component.

The arrangement may include at least one urging member urging the second support component away from the first support component in the same direction in which the feet project. The arrangement may include only one urging member mounted on the guided pin or two urging members which are equally spaced on opposite sides of the guide formation, each urging member being in the form of a compressed spring located in the channel defined by said other pair of spokes and acting between the spokes and the second support component.

The arrangement may include a securing formation for securing it, in use, to a support structure of an item of furniture.

The arrangement may include a securing formation connected to the guided pin, which securing formation serves to hold the guided pin captive in the passage defining unit.

In accordance with yet another aspect of the invention there is provided an item of furniture which includes a support assembly as hereinbefore described, and an upper portion of an item of furniture mounted on the support assembly.

The item of furniture may be a table, the upper portion of the item of furniture being a table top. Instead, the item of furniture may be a stool or a chair, the upper portion of the item of furniture being a seat portion of the stool or chair.

In accordance with still another aspect of the invention there is provided an item of furniture which includes a self-stabilizing arrangement as hereinbefore described, and an upper portion of an item of furniture connected to the first support component thereof.

The item of furniture may be a table, the upper portion of the item of furniture being a table top. Instead, the item of furniture may be a stool or a chair, the upper portion of the item of furniture being a seat portion of the stool or chair.

The invention will now be further described, by way of a non-limiting example, with reference to the accompanying schematic drawings, in which.

Figure 1:
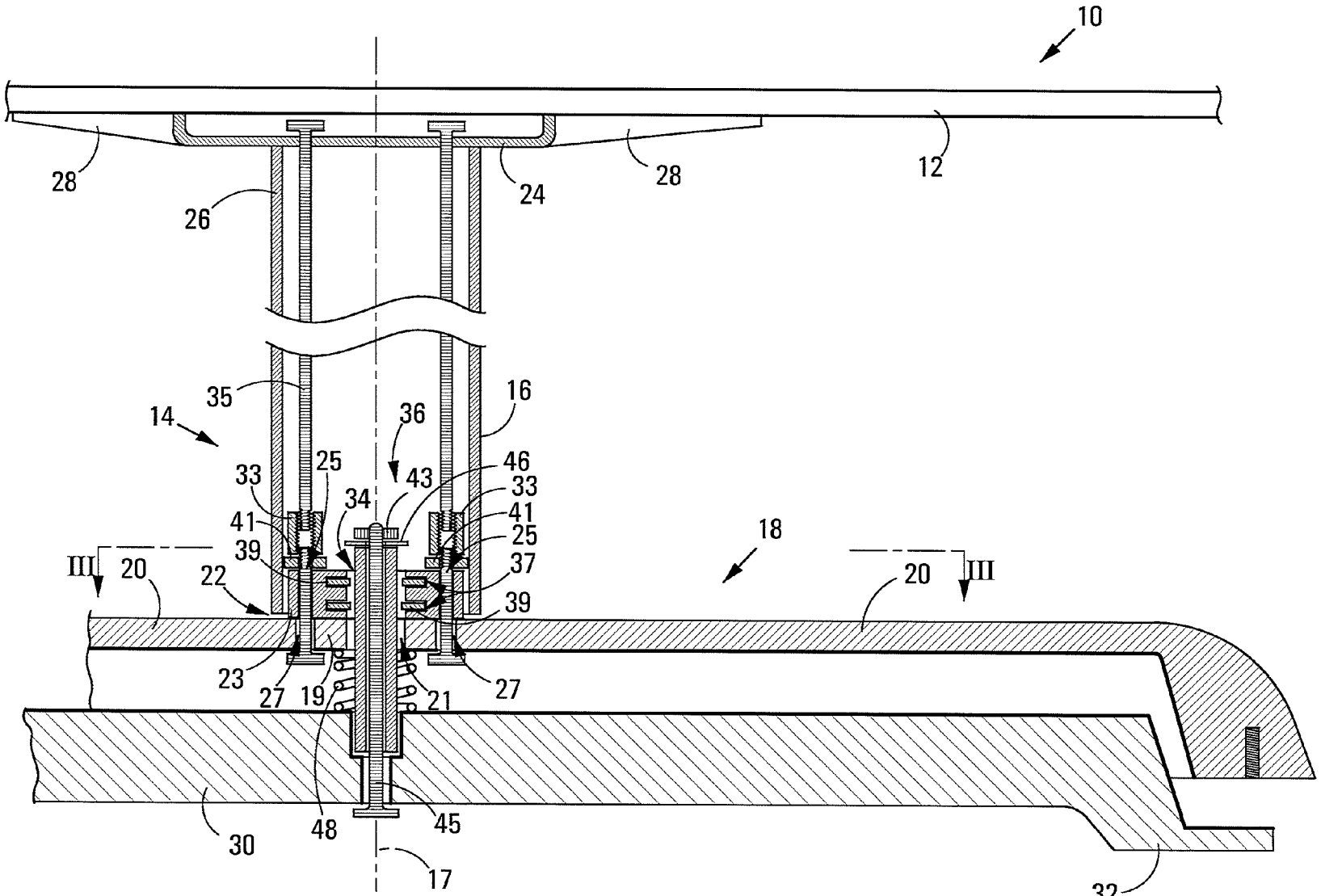
FIG. 1 shows, fragmentarily and on an enlarged scale, a sectional side elevation of a table in accordance with the invention, the table including the support assembly in accordance with the invention 1.

Referring to FIG. 1 of the drawings, reference numeral 10 generally indicates a table in accordance with the invention. The table 10 comprises: an upper portion in the form of a table top 12 (not sectioned) mounted on a support assembly 14 in accordance with the invention. The support assembly 14, in turn, comprises an operatively upright elongated tubular hollow post 16 and a spider formation 18 which includes four radially projecting equiangularly spaced spokes 20 secured to a lower end 22 of the post 16. The spider formation 18 is shaped such that a plane defined by the spokes 20 is normal to a longitudinal axis 17 of the post 16. A mounting member 24 is connected to an upper end 26 of the post 16, the mounting member 24 comprising a series of four equiangularly spaced mounting flanges 28. Each mounting flange 28 has a pair of apertures (not shown) therethrough, through which apertures screws (also not shown) are passed, the screws being screwed into the table top 12, to mount the table top 12 on the support assembly 14.

Each spoke 20 is channel-shaped and opens downwardly, thus having an inverted U-shape in cross-sectional profile. A displaceable support member in the form of an elongated displaceable arm 30 is received in one pair of aligned spokes 20, extending lengthwise along the said pair of spokes 20. The displaceable arm 30 is of mild steel construction, being in the form of a casting. The displaceable arm 30 provides a downwardly projecting foot 32 at each end thereof. The spider formation 18 forms a locating arrangement for keeping the displaceable arm 30 perpendicular to the other pair of spokes 20 by restricting pivotal displacement of the displaceable leg 30 about the longitudinal axis 17 of the post 16.

The support assembly 14 includes a passage defining unit 36 which is fastened to a centre portion 19 of the spider 18 about an opening 21 therein, to be located centrally with respect to the spokes 20. The passage defining unit 36 is shown in more detail in FIG. 3 and comprises a hollow guide member 23 which has a central passageway and two spaced fastening bores 25 which align with associated holes 27 in the spider 18. The guide member 23 is fastened to the spider 18 by means of bolts 31 and nuts 33. The nuts 33 also serve to attach the post 16 to the spider 18 by means of long bolts 35 that pass through aligned holes in the mounting member 24. The guide member 23 has a groove 37 close to each end of its central passageway in each of which a split ring 39 is located. It will be appreciated that the split rings 39 define a guide passage 34.

A guided formation in the form of a circular cylindrical guided pin 38 projects upwardly from the arm 30, being secured thereto by a nut 43 and bolt 45. The guided pin 38 is coaxial with the post 16. The guided pin 38 is longitudinally slidably received in the guide passage 34, so that the guided pin 38 is displaceable in the passage defining unit 36. The guided pin 38 constitutes a guided formation, the passage defining unit 36 constituting a guide formation.

The pin 38 has a central bore through which the shank of the bolt 45 passes.

A stop washer 46 is held by the nut 43. The stop washer 46 has a diameter which is greater than the inner diameter of the central passageway of the guide member 23 so that the washer 46 limits sliding displacement of the pin 38 in the passage 34.

The support assembly 12 includes a coiled spring 48 under compression, about the pin 38 between the arm 30 and the spider formation 18, to urge the arm 30 operatively downwardly away from the spider formation 18.

Figure 2:
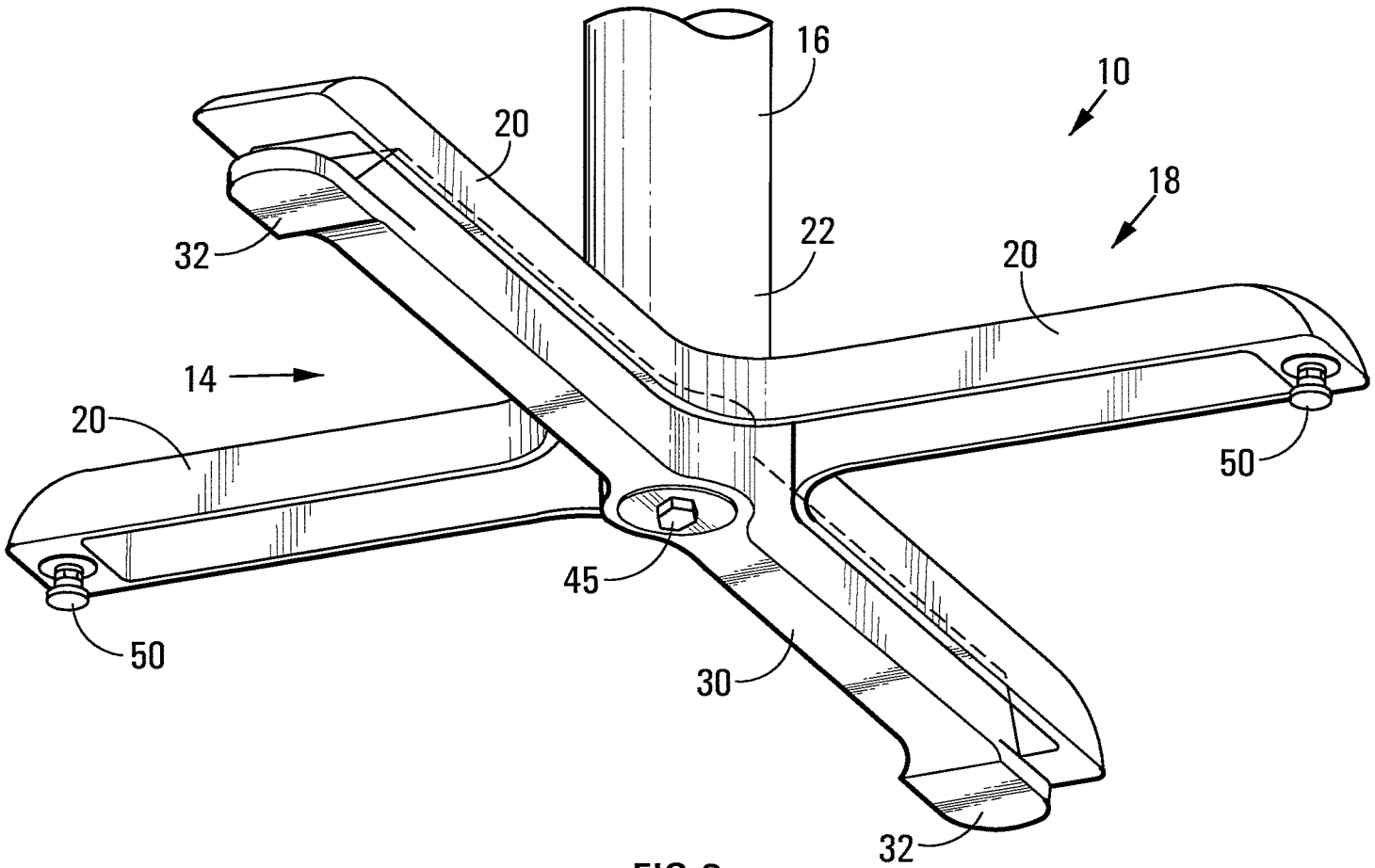
FIG. 2 shows a three-dimensional view from below of the table.

As can be seen in FIG. 2 of the drawings, the spokes 20 of the other pair of aligned spokes 20, i.e. the spokes 20 which extend perpendicularly to the arm 30, are each, at their outer ends, provided with an operatively downwardly projecting fixed foot 50. Said pair of spokes 20 thus forms a first support member which has a foot 50 at each end thereof. The spider formation 18 thus constitutes a locating: arrangement, keeping the arm 30 perpendicular to the other pair of spokes 20 by restricting swivelling of the arm 30 about the passage 34.

Figure 3:
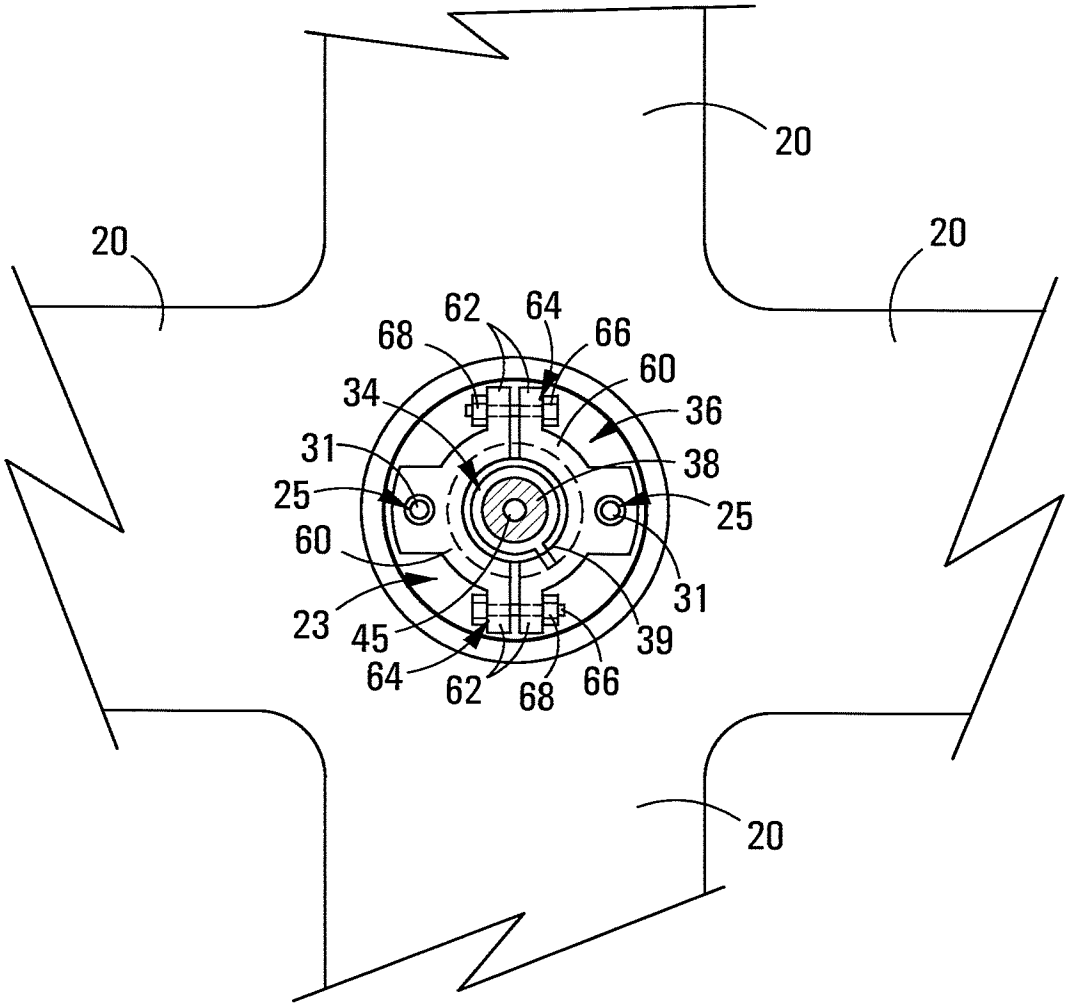
FIG. 3 shows a sectioned view along line III-III in FIG. 1.

Referring to FIG. 3, it will be seen that the guide member 23 comprises a pair of complementary substantially semicircular guide shells 60 that abut one another to define the central passageway. Each guide shell 60 has end projections 62 which have aligned transverse holes 64 through which tightening bolts 66 pass, to tighten the two guide shells to one another and thereby vary the size of the passageway, by means of lock nuts 68. Each guide shell 60 also has a central projection 70 which have the longitudinal bores 25.

It will be appreciated that the passage defining unit 36 is adjustable, by means of the bolts 66 and nuts 68, to vary the size of the guide passage 34, by squeezing the split rings 39 closed or by allowing them to open. It will further be appreciated that the passage defining unit 36 is fastenable to the spider 18 after it has been adjusted to conform with the guided pin 38. Thus, when the support assembly 14 is manufactured, the split rings 39 are inserted in the grooves 37 of one guide shell 60, the other guide shell 60 is then engaged therewith and the bolts 66 and nuts 68 are used to clamp the two guide shells 60, with the split rings 39 in their grooves 37, together. The passage defining unit 36 thus formed is then placed on the guided pin 38 with which it is to be used, and the two guide shells 60 tightened by means of the bolts 66 and nuts 68 until the correct clearance is obtained. The calibrated passage defining unit 36 is then removed from the guided pin 38 and fastened to the spider 19 and the guided pin 38 is then engaged therewith.

The diameter of the guide passage 34 as defined by the split rings 39 is such that there is limited clearance between the guided pin 38 and the inner surfaces of the split rings 39, so that there is frictional locking of the guided pin 38 when a couple, or a nett moment about an axis transverse to a longitudinal axis of the guided pin 38 is exerted on the arm 30, which typically happens when the table 10 is located on an uneven surface. The arm 30 is thus only slidably displaceable in the guide passage 34 when there is substantially no nett moment acting on the arm 30 about an axis coaxial with a line drawn between the two fixed feet 50.

The support assembly 14 without the post 16 thus defines a self stabilizing arrangement in accordance with the invention. In use, the support assembly 14 supports the table top 12 on a support; surface such as the ground (not shown). When the ground surface is uneven, the support assembly 14 is automatically operable to displace the arm 30 relative to the spider formation 18 such that all four feet 50, 32 bear against the support surface.

When, for instance, the ground is uneven such that both of the fixed feet bear against the ground, but only one of the displaceable feet 32 at a time touches the ground, the table 10 will tend to rock by pivoting of the spider formation 18 about the axis aligned with a line interconnecting the fixed feet 50. During such rocking, the displaceable arm 30 is urged downwardly by the springs 48 when both feet 32 are clear of the ground, i.e. when no external forces are exerted on the feet 32, the arm 30, via the guided pin 38, being automatically locked in position in the passage defining unit 36 when either of the feet 32 abuts against the ground. The displaceable arm 30 thus automatically finds a position where both its feet 32, as well as the fixed feet 50 bear against the ground.

In instances where the ground is uneven such that both the displaceable feet 32, but only one of the fixed feet 50, bear against the ground, the arm 30 is displaced upwardly with its guided pin 38 moving in the guide passage 34 until both the fixed feet 50 bear against the ground surface. It will be appreciated that, in order for the arm 30 to be in equilibrium, upward forces exerted by the ground on the displaceable feet 32 must be equal to each other. This is because the feet 32 are equally spaced from the guided pin 38. These equal upward forces cause upward displacement of the arm 30 against the urging of the spring 48 until the table support structure 14 attains a stable, static condition.

Once all four feet 32, 50 bear against the ground, the table 10 remains stable, as the arm 30, and therefore the feet 32, is effectively locked in position. This is because any attempt at rocking the table 10 will result in the application of unequal forces to the feet 32, causing automatic and immediate frictional locking of the arm 30, via the guided pin 38 in the passage defining unit 36.

The invention claimed is:

1. A support assembly for an item of furniture, comprising:

an elongated support structure for connection at an operatively upper end thereof to an upper portion of an item of furniture;

a first pair of feet connected to the support structure, at or adjacent an operatively lower end thereof;

an elongated guide formation connected to the support structure and extending lengthwise relative to the support structure;

a support member displaceable with respect to the support structure which has a second pair of feet at or adjacent an operatively lower end thereof, the displaceable support member being arranged relative to the support structure so that a line drawn between the feet of the first pair is transverse to a line drawn between the feet of the second pair;

the displaceable support member also being provided with an elongated guided formation complementary to and longitudinally slidably engaged with the guide formation, so that the displaceable support member is slidably displaceable along a rectilinear guide path which is transverse to the lines drawn between both the pairs of feet, with one of the guide formation and the guided formation being in the form of a guided pin, the other one of the guide formation and the guided formation being in the form of a passage defining unit defining a guide passage within which the guided pin is longitudinally slidably received, the dimensions of the guide passage and the guided pin being such that automatic frictional engagement of the guided pin occurs, in use, with a surface of the guide passage in response to pivoting of the displaceable support member about a pivot axis which is transverse to the displaceable support member's guide path, automatically to anchor the displaceable support member frictionally against sliding displacement relative to the support structure, wherein the passage defining unit has a hollow adjustable guide member whereby the dimension of the guide passage is adjustable in accordance with the dimension of the guided pin; and wherein the passage defining unit is fastenable to one of the support structure and the support member once it has been adjusted, such that the passage defining unit may first be adjusted to conform with the guided pin and then be fastened to the support structure or the support member, wherein the guide member comprises a pair of guide shells with a tightening mechanism for tightening the guide shells together, thereby varying the dimension of the guide passage defined therebetween, wherein the passage defining unit has a pair of longitudinally spaced adjustable guide components, inner surfaces of which define the guide passage and are housed in the guide member, and wherein the guide shells have longitudinally spaced grooves in which the guide components are received.

2. The support assembly as claimed in claim 1, wherein the guide passage is of circular cross-section and the guided pin is circular cylindrical.

3. The support assembly as claimed in claim 2, wherein the guide shells have a substantially semicircular surface.

4. The support assembly as claimed in claim 1, wherein the passage defining unit has fastening formations for fastening the guide passage to one of the support structure and the support member.

5. The support assembly as claimed in claim 4, wherein the fastening formations comprise bores in the guide member.

6. The support assembly as claimed in claim 1, wherein the guided formation comprises the guided pin, and the guided pin projects operatively upwardly from an operatively upper end of the support member; and the guided formation comprises the guide passage defined by the passage defining unit, with the passage defining unit being centrally located with respect to the support structure at an operatively lower end thereof.

7. The support assembly as claimed in claim 1, further comprising an elongated operatively upright post and a spider formation connected to an operatively lower end of the post.

8. The support assembly as claimed in claim 7, wherein the spider formation comprises four radially outwardly projecting spokes which are equiangularly spaced about a longitudinal axis of the post, each spoke being channel-shaped and opening operatively downwardly.

9. The support assembly as claimed in claim 8, wherein the passage defining unit is removably fastened about an aperture in the spider formation and projects centrally operatively upwardly therefrom.

10. The support assembly as claimed in claim 8, wherein one pair of aligned spokes is provided with the first pair of feet, the feet of the first pair respectively being provided at ends of the spokes of said one pair of spokes.

11. The support assembly as claimed in claim 10, wherein the displaceable support member comprises an arm which is received in a channel defined by the other pair of aligned spokes and extending lengthwise therealong, the feet of the second pair of feet respectively being provided at the ends of the arm.

12. The support assembly as claimed in claim 11, wherein the guided pin is removably secured to the arm.

13. The support assembly as claimed in claim 1, further comprising at least one urging member for urging the displaceable support member away from the support structure.

14. The support assembly as claimed in claim 13, wherein the urging member is located on the guided pin.

15. The support assembly as claimed in claim 13, wherein the support assembly includes two urging members which are equally spaced on opposite sides of the guided pin.

16. The support assembly as claimed in claim 1, further comprising a securing formation connected to an operatively upper end of the guided pin, wherein the securing formation holds the guided pin captive in the passage defining unit.

17. The support assembly as claimed in claim 1, wherein the feet of the second pair are spaced the same distance from a longitudinal axis of the guide formation.

18. The support assembly as claimed in claim 17, wherein the feet of the second pair are spaced the same distance from a longitudinal axis of the guide formation as the feet of the first pair.

19. The support assembly as claimed in claim 1, wherein the line drawn between the first pair of feet and the line drawn between the second pair of feet are at right angles to each other.

20. The support assembly as claimed in claim 1, wherein an upper portion of the item of furniture is mounted on the support assembly.

21. The support assembly as claimed in claim 20, wherein the item of furniture is a table, the upper portion of the item of furniture being a table top.

22. A method of manufacturing a support assembly for an item of furniture, the method comprising:

providing an elongated support structure for connection at an operatively upper end thereof to an upper portion of an item of furniture and having a first pair of feet connected therewith, at or adjacent an operatively lower end thereof, and an elongated guide formation connected therewith and extending lengthwise relative to the support structure;

providing a support member displaceable with respect to the support structure which has a second pair of feet at or adjacent an operatively lower end thereof, the displaceable support member being arrangeable relative to the support structure so that a line drawn between the feet of the first pair is transverse to a line drawn between the feet of the second pair and also has an elongated guided formation complementary to and longitudinally slidably engageable with the guide formation, so that the displaceable support member is slidably displaceable along a rectilinear guide path which is transverse to the lines drawn between both the pairs of feet, with one of the guide formation and the guided formation being in the form of a guided pin, the other one of the guide formation and the guided formation being in the form of a passage defining unit defining a guide passage within which the guided pin is longitudinally slidably received, the dimensions of the guide passage and the guided pin being such that automatic frictional engagement of the guided pin occurs, in use, with a surface of the guide passage in response to pivoting of the displaceable support member about a pivot axis which is transverse to the displaceable support member's guide path, automatically to anchor the displaceable support member frictionally against sliding displacement relative to the support structure, with the passage defining unit having a hollow adjustable guide member whereby the dimension of the guide passage is adjustable in accordance with the dimension of the guided pin; and being fastenable to one of the support structure and the support member once it has been adjusted, wherein the passage defining unit is first adjusted to conform with the guided pin and it is then fastened to the support structure or the support member; and wherein the guide member comprises a pair of guide shells with a tightening mechanism for tightening the guide shells together, thereby varying the dimension of the guide passage defined therebetween, wherein the passage defining unit has a pair of longitudinally spaced adjustable guide components, inner surfaces of which define the guide passage and are housed in the guide member, and wherein the guide shells have longitudinally spaced grooves in which the guide components are received.

23. A self-stabilizing arrangement for an item of furniture, comprising:

an elongated first support component having at each end a foot projecting in the same direction;

an elongated guide formation connected to the first support component;

and an elongated second support component having at each end a foot projecting in the same direction as the feet of the first support component, the second support component including an elongated guided formation complementary to and longitudinally slidably engaged with the guide formation, one of the guide formation and the guided formation being in the form of a guided pin, the other one of the guide formation and the guided formation being in the form of a passage defining unit connected to the associated one of the first and the second support components and which defines a guide passage within which the guided pin is longitudinally slidably received, such that the second support component is slidably displaceable relative to the first support component, wherein the passage defining unit comprises a hollow adjustable guide member whereby the dimension of the guide passage is adjustable in accordance with the dimension of the guided pin;

and the passage defining unit being fastenable to one of the first support component and the second support component once it has been adjusted, such that the passage defining unit may first be adjusted to conform with the guided pin and then be fastened to the first support component or the second support component, wherein the guide member comprises a pair of guide shells with a tightening mechanism for tightening the guide shells together, thereby varying the dimension of the guide passage defined therebetween, wherein the passage defining unit has a pair of longitudinally spaced adjustable guide components, inner surfaces of which define the guide passage and that are housed in the guide member, and wherein the guide shells have longitudinally spaced grooves in which the guide components are received.

24. The self-stabilizing arrangement as claimed in claim 23, wherein the guide passage is of circular cross-section and the guided pin is circular cylindrical.

25. The self-stabilizing arrangement as claimed in claim 24, wherein the guide shells have a substantially semicircular surface.

26. The self-stabilizing arrangement as claimed in claim 23, wherein the passage defining unit has fastening formations for fastening one of the first support component and the second support component.

27. The self-stabilizing arrangement as claimed in claim 26, wherein the fastening formations comprise bores in the guide member.

28. The self-stabilizing arrangement as claimed in claim 23, wherein the guided formation comprises the guided pin, the guided pin being centrally connected to the second support component and projecting in the opposite direction to the feet and the guide formation comprises the passage defining unit, the passage defining unit being removably fastened to and centrally located with respect to the first support component.

29. The self-stabilizing arrangement as claimed in claim 28, wherein the first support component and the second support component are orthogonal.

30. The self-stabilizing arrangement as claimed in claim 23, further comprising a locating arrangement, the locating arrangement keeping the first and the second support components in a predetermined relative configuration.

31. The self-stabilizing arrangement as claimed in claim 30, wherein the locating arrangement includes a pair of longitudinally aligned spokes connected to the first support component and projecting radially outwardly therefrom, such that the spokes and the first support component are orthogonal, the spokes being shaped to define a locating channel opening in the same direction as the direction in which the feet project, the second support component being located in a channel defined by one pair of aligned spokes.

32. The self-stabilizing arrangement as claimed in claim 23, wherein the guide formation and the guide components are shaped and dimensioned such that there is limited clearance between the guided pin and inner surfaces of the guide components, so that automatic frictional locking of the second support component relative to the first support component occurs when a net moment about an axis transverse to a longitudinal axis of the guided pin is exerted on the second support component.

33. The self-stabilizing arrangement as claimed in claim 23, further comprising at least one urging member for urging the second support component away from the first support component in the same direction in which the feet project.

34. The self-stabilizing arrangement as claimed in claim 33, wherein one urging member is mounted on the guided pin.

35. The self-stabilizing arrangement as claimed in claim 23, further comprising a securing formation for securing it, in use, to a support structure of an item of furniture.

36. The self-stabilizing arrangement as claimed in claim 23, further comprising a securing formation connected to the guided pin, wherein the securing formation serves to hold the guided pin captive in the passage defining unit.

37. The self-stabilizing arrangement as claimed in claim 23, wherein an upper portion of the item of furniture is connected to the first support component of the self-stabilizing arrangement.

38. The self-stabilizing arrangement as claimed in claim 37, wherein the item of furniture is a table, the upper portion of the item of furniture being a table top.

* * * * *